United States Patent [19]

Raeber

[11] 4,205,753

[45] Jun. 3, 1980

[54] HYDRAULIC BUFFER FOR A VEHICLE

[76] Inventor: Victor Raeber, 10, rue des Communaux, Vevey, Vaud, Switzerland, CH-1800

[21] Appl. No.: 839,363

[22] Filed: Oct. 4, 1977

[30] Foreign Application Priority Data

Oct. 11, 1976 [CH] Switzerland ..... 12810/76

[51] Int. Cl.[2] ..... B61G 11/12

[52] U.S. Cl. ..... 213/223; 137/853; 188/287; 188/318; 213/43; 293/134

[58] Field of Search ..... 293/DIG. 2, 84, 85, 293/89, 107, 134; 213/223, 69, 43; 188/281, 286, 287, 314, 318; 137/853, 860

[56] References Cited

U.S. PATENT DOCUMENTS

| | | | |
|---|---|---|---|
| 3,417,775 | 12/1968 | Smith | 137/853 X |
| 3,596,774 | 8/1971 | MacCurdy | 213/43 X |
| 3,701,402 | 10/1972 | Chelnokov et al. | 213/43 X |
| 3,799,193 | 3/1974 | Greenwood | 137/853 |

*Primary Examiner*—Sherman D. Basinger

[57] ABSTRACT

A hydraulic buffer for a vehicle, the buffer including a piston and cylinder arrangement in which the piston is displaced by the pressure of hydraulic fluid, the hydraulic fluid being contained in a chamber defined by the piston and cylinder, the chamber being in flow communication with a reservoir for the hydraulic fluid, a valve being provided for permitting flow from the chamber to the reservoir, the valve comprising a perforated resilient sleeve in flow communication with the interior of the chamber and a resilient bush mounted on the periphery of the sleeve, an increase in pressure within the chamber causing deformation of the sleeve and bush, the deformation constituting the opening of the valve.

16 Claims, 5 Drawing Figures

HYDRAULIC BUFFER FOR A VEHICLE

The present invention concerns a vehicle buffer which, upon impact, acts both as a force limiting device to protect the chassis of the vehicle and also to dissipate the major portion of the kinetic energy available in such an impact in the form of heat.

According to the present invention there is provided a hydraulic buffer for a vehicle, comprising a buffer plate, a piston and cylinder arrangement, the axis of the cylinder, in use, extending substantially parallel to the longitudinal axis of the vehicle either the piston or the cylinder bearing against the buffer plate, the other bearing, in use, against the chassis of the vehicle, a chamber being defined between the cylinder and the piston, which chamber is, in use, filled with a hydraulic fluid, whereby forces tending to compress the buffer pressurise the hydraulic fluid, valve means capable of permitting the outflow of hydraulic fluid from the chamber into a reservoir therefor, non-return valve means capable of permitting the inflow of hydraulic fluid into the chamber from the reservoir and spring means acting to tend to return the components of the buffer to their rest position wherein the valve means comprises at least one resilient bush mounted on the periphery of a perforated resilient sleeve, the interior of the sleeve communicating with the interior of the chamber, the pressure of the hydraulic fluid in the chamber direction tending to increase the diameter of the bush and to reduce the diameter of the sleeve thereby causing elastic deformation between the bush and the sleeve, the play between the bush and the sleeve constituting to the opening of the valve means.

Figure 1:
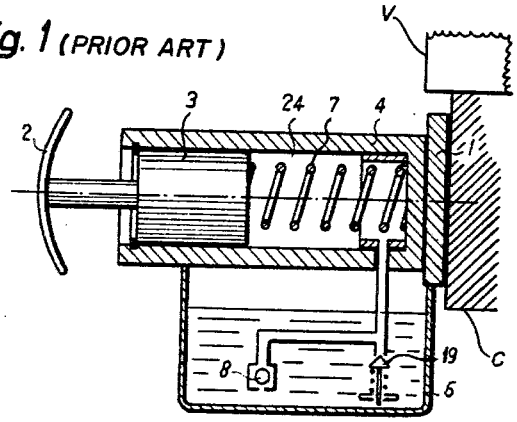
Fig. 1 (PRIOR ART)
Figure 4:
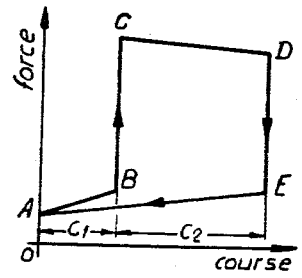
Figure 2:
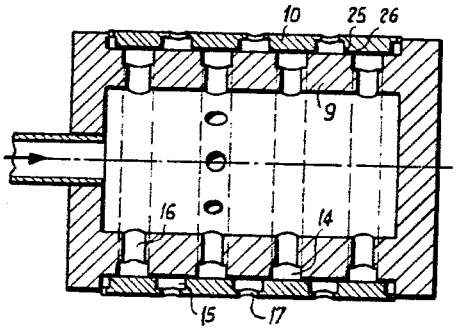
Figure 5:
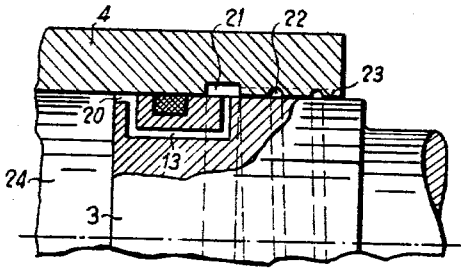
Figure 3:
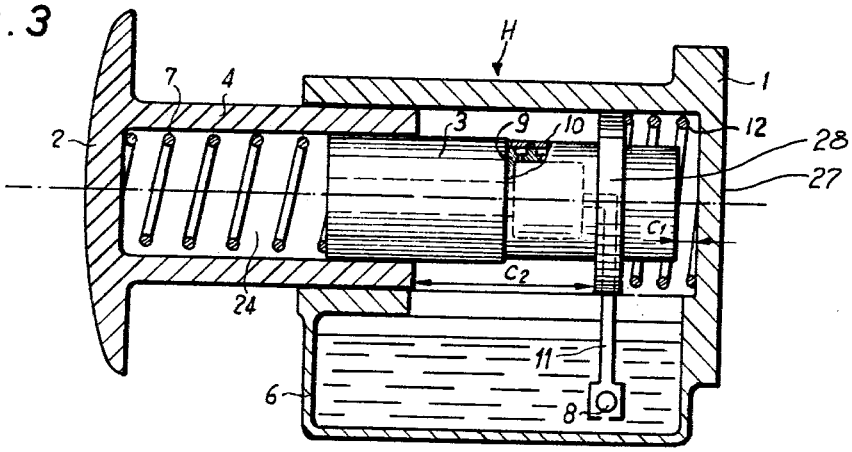

The invention will be further described, by way of example, with reference to the accompanying drawings, in which:

FIG. 1 is a longitudinal section through a hydraulic buffer of a conventional type, for comparison only, FIG. 2 is a view, partially in section, of a valve arrangement provided in a buffer according to the present invention, FIG. 3 is a longitudinal section through a buffer according to the present invention, FIG. 4 is a graph showing the operation of a buffer of the type shown in FIG.3, and FIG. 5 shows an air evacuating device forming part of a buffer in accordance with the present invention.

The operation of hydraulic buffers, utilised as force limiting devices, is well known. Shown very schematically in FIG. 1, a common type of buffer comprises a tube 4 secured to the chassis C of the vehicle by means of a panel 1. This tube acts as a cylinder in which a piston 3 slides, the piston being mounted on the buffer plate 2. A return spring 7 is also provided which tends to return the buffer plate to its rest position.

The buffer also comprises a reservoir 6 located below the cylinder 4 as well as conduits including a non-return valve 8 and a pressure limiting valve 19 for the hydraulic fluid.

When the plate 2 is subjected to a force tending to compress the spring 7, the hydraulic fluid in the chamber 24 is subjected to pressure. Should this pressure rise above a pre-determined value, the valve 19 is caused to rise off its seat, allowing the hydraulic fluid to pass therethrough. The fluid thus flows out of the chamber 24 into the reservoir 6. In so doing, energy is dissipated, this energy being a function of the product of the pressure and the piston displacement within the cylinder, that is to say, the volume of fluid expelled from the chamber 24 into the reservoir 6. The amount of energy which can be dissipated in this manner may be considerable and can be increased by increasing the pressure and/or the amount of piston displacement.

Under normal circumstances of impact, the piston 3 is halted at the end of the compression stroke of the buffer and the energy dissipated by the buffer is at a maximum. In the case of a vehicle striking against a stationary vehicle the impact force transmitted to the vehicle itself is small. The energy dissipated by the buffer is equal to half the kinetic energy of the moving vehicle at the moment of impact. Impact forces transmitted to the vehicle are greatly increased if the kinetic energy impacting vehicle is greater than that which the buffers can dissipate. In such a case, the pistons reach the end of their travel and can only transmit the impact forces to the vehicle.

Once maximum compression of the spring is reached, the spring 7 acts to release the buffer members, which causes refilling of the chamber 24 with hydraulic fluid. This fluid comes from the casing through the non-return valve 8.

Buffers of the type shown in FIG. 1 are not as effective as had been hoped due to the valve 19. The output of the valve 19 is usually insufficient for practical purposes. Thus, for example, in a collision between two vehicles, the initial rate of displacement of the piston 3 relative to the cylinder 4 is relatively high. This is a function of the relative speeds of the two impacting vehicles. If, for example, the outer diameter of the piston is 150 mm, and if the maximum compression force is $10^6$ newtons per buffer, which is the normal value for rail vehicles, the maximum pressure in the cylinder is approximately 570 bars. This is a very high value and permits only a small piston displacement. If, however, the impact speed is 15 km/h (4.17 m/s) the rate of flow of hydraulic fluid passing through the valve 19 has a maximum of about 38 l/sec. This is a comparatively high rate, particularly when taking into account the high value of the pressure, and necessitates flow passages having large cross-sections. This can be achieved only by providing large diameter displacement member of the valve and permitting it to have a relatively long travel.

It is believed that a valve as shown in FIG.2 will permit the necessary throughput. Such a valve comprises a resilient sleeve 9, around which a resilient bush 10 is provided. Both said sleeve and bush are substantially cylindrical and the bush has an internal diameter less than the external diameter of said sleeve. Thus, the bush is a press fit on said sleeve such that the bush and sleeve remain in sealing contact with one another until the pressure of the hydraulic fluid in the chamber 24 exceeds a predetermined value. Grooves 14 and 15 which are annular are formed in the sleeve 9 and bush 10 respectively. Hydraulic fluid is fed to the grooves 14 formed in the sleeve 9 through apertures 16 and is led away from the grooves 15 in the bush 10 through apertures 17. These grooves 14 and 15 are displaced relative to one another so that each groove in the bush or sleeve, is interposed between two grooves of the other. The two end grooves are, of course, exceptions to this rule. A groove on either the bush on sleeve is separated from the adjacent groove on the sleeve or bush by a small distance such as 1mm. In other words, the spacing between adjacent walls 25 and 26 of two adjacent grooves is of the order of 1 mm. By ensuring that the adjacent grooves are not in fluid flow communication with one another in the rest state of the buffer, the interior space of the sleeve 9 is sealed.

The hydraulic fluid pressure prevailing in the chamber 24 also prevails in the interior of the sleeve 9 and through the apertures 16 in the grooves 14. This pressure acts on the bush 10 and on the sleeve 9, and tends to increase the diameter of the bush 10 and reduce that of the sleeve 9.

When the pressure reaches a particular valve, the deformation of these two parts produces play at their interface, thereby permitting hydraulic fluid flow from the grooves 14 to the grooves 15. The flow rate produced is high due to the very high pressure of the fluid which is released by the moving apart of the sleeve 9 and the bush 10. Once in the grooves 15, the hydraulic fluid escapes through the plurality of small apertures 17. The total cross-sectional area of these apertures is very high compared with the cross-sectional area of the play produced between the sleeve 9 and the bush 10. The rate at which the hydraulic fluid flows out of the bush is therefore low compared with the rate of the fluid flow in the region between adjacent wall portions 26 and 25. Such a valve, even with only a small amount of play between the sleeve and bush permits a very high throughput because the relevant perimeter is very large, being equal to the total length of the edges 26, that is to say, to twice the number of grooves 14 multiplied by the perimeter of each groove. The construction also makes it possible to design valves of maximum diameter, since it is of the same order of magnitude as the diameter of a piston itself. Thus a relatively small amount of play between the bush 10 and the sleeve 9 permits a high throughput.

The bush acts as a closure device. The amount of movement of the bush is extremely small, the mass displaced is similarly very small, and the valve cannot vibrate. This is frequently the case in valves of the type shown in FIG. 1. In such known valves, the mass of the closure member is high and the spring force maintaining the valve in its closed position is weak compared with the same components of the valve shown in FIG. 2.

The buffer shown in FIG. 3 includes a valve as shown in FIG. 2. The buffer is substantially similar to the buffer shown in FIG. 1, but additionally includesa housing H, the bottom of which is provided with reservoir 6. An auxiliary spring 12 is mounted on the right-hand end of a member 3 which functions in a manner similar to the piston 3 in FIG. 1. However, in FIG. 3, the buffer plate 2 is mounted on the cylinder or tube 4. The spring 12 is confined between the end wall 27 of the housing H and an annular ring 28 on the member 3.

In the event of an impact, the hydraulic fluid contained in the chamber 24 transmits the force acting on the plate 2 to the left-hand (as shown) end face of the piston 3. This force is initially absorbed by the auxiliary spring 12 which is compressed by the piston. Thus, initially on impact, the buffer moves a few millimeters. The right-hand end face of the piston 3 then bears against the locating plate 1 mounted on the chassis of the vehicle. If compression forces are still acting on the buffer plate 2 at this time, the pressure on the hydraulic fluid in the chamber 24 is increased. This pressure is transmitted through an internal conduit to the outer chamber of a sleeve 9 similar to that shown in FIG. 2. The bush 10 is subjected to tension, expands and, when the pressure reaches a predetermined level, permits the discharge of the hydraulic fluid from the exterior of the piston into the reservoir 6. A valve 8, carried by a conduit 11 is immersed in the hydraulic fluid in the casing and permits re-filling of the chamber 24 of the buffer on cessation of its compression. The return action of the buffer is effected by means of the springs 12 and 7.

The graph shown in FIG. 4 represents the behaviour of a buffer as shown in FIG. 3. The compression strokes of the buffer are shown along the abscissa, and the corresponding forces exerted by the buffer are shown along the ordinate. The cycle is shown by the arrow. During a compression, such as an impact, the force of the auxiliary spring 12 is represented by the straight line A - B. During the first stroke $C_1$, that traversed by the spring 12, the force increases from an initial value (point A) to that of a higher value corresponding to the point B. If the compression force is sufficient to exceed its value at the point B, the curve is continued, the pressure of the liquid increased rapidly. Once the point B has been reached and exceeded the valve lifts by an amount sufficient to permit the necessary outflow of hydraulic fluid in dependence upon the rate of compression of the buffer. As already stated, this outflow is effected with the dissipation of energy. This is due to the fact that the kinetic energy of the moving vehicle reduces due to its reduction of the speed, whilst the speed of the initially stationary vehicle increases. The rate of compression of the buffer is therefore reduced and the opening stroke of the valve is also reduced. The pressure in the chamber 24 and the compression of the buffer slightly decrease, as is indicated by the line C - D in the graph. The point D represents the point at which compression is concluded. The energy dissipated in the buffer is represented by the area of the polygon formed by the points O - A - B - C - D and the abscissa. Restitution of the buffer is effected by the springs 7 and 12 acting in series, which restore the buffer components to their initial positions, this being represented by the line E A of the graph.

In this restitution, the springs supply energy to the vehicles, but this energy is negligible in comparison with the energy dissipated in the buffer. The springs are so dimensioned to permit the components to be restored to their original positions and to confer, on the buffer assembly, the elasticity necessary for the first part $C_1$ of the action, the second portion $C_2$ of the action being rigid.

The graph shown in FIG. 4 does not take into account the frictional interaction between the various moving parts. Whilst such friction may slightly modify the graph, the overall principle remains unchanged. However, the graph illustrates the advantages of a buffer of the type shown in FIG. 3 which presents, for short movements and low forces, a degree of flexibility which is useful during normal travel of the vehicle in convoy, such as a train. During an impact, for example, when a moving vehicle collides with a stationary vehicle, which often occurs at railway stations or goods yards were trains are made up, the buffer acts as a force limiting device. It can dissipate maximum energy, since the area bounded by the points B - C - D - E of the graph is a maximum. The value of the force represented by the C corresponds to the maximum admissible value of compression of the chassis.

In addition a device may be provided for evacuating air which may permeate into the chamber 24. Such a device is shown in FIG. 5 and comprises a conduit 13 provided in the piston 3. At one end, the conduit 13 communicates with the chamber 24 through an opening 20 at a point located at the upper end of the piston, that is to say, its upper generatrix. This opening 20 has a relatively small cross-section. At its other end, the conduit 13 communicates with an annular groove 21 formed in the cylinder or tube 4. A helical groove 22 connects the groove 21 with the end of the cylinder or tube and terminates in an exhaust aperture 23. During normal travel, a vehicle is subjected to low compression forces which are absorbed, as already mentioned, by the springs 12. These compression forces are transmitted from the buffer plate to the spring by means of the fluid in the chamber 24. Their action is therefore dependent on the pressure of the fluid which is itself variable. Continued application of compressive forces to the buffer 2 displaces the piston 3 which closes said exhaust aperture 23.

The air hole is at the summit of the piston. Pressurising the liquid in the chamber 24 causes any air present to be forced through the evacuating opening 20, the passage 13, the groove 21, the helical groove 22 and the exhaust aperture 23. The cross-section of all these passages is small, so that the output of hydraulic fluid expelled is reduced, whereas the amount of air which can be exhausted is large, due to its low dynamic viscosity. The helical groove, due to its small cross section and long length tends to retard, to a considerable extent, the leakage of hydraulic fluid. If the amount of movement due to compression forces exceeds the width of the annular groove 21, the air evacuation passage 13 no longer communicates with the groove, and the air evacuation device is rendered inoperative.

FIGS. 1, 2, 3 and 4 are somewhat schematic illustrations of the principle of construction of a buffer in accordance with the present invention. It will be obvious that the arrangement additionally includes abutment members for preventing exaggerated displacement of any components and sealing joints for isolating the assembly from the exterior and the chamber 24 from the casing. It should be pointed out that, during normal operation, the chamber 24 is not subjected to a high pressure, and during the working of the piston, the output of hydraulic fluid is so relatively large that a completely leak-free joint is not important.

In FIGS. 2 and 3, the bush 10 is shown as being made in a single part and is shown to comprise grooves 15 and the apertures 17. It is obvious that this bush may be made of a plurality of annular parts stacked one upon the other, each overlapping at least one groove in the sleeve 9. The circular holes may also be made in the form of turrets or teeth. The assembly of the tube 4 and piston 3 is generally cylindrical and has a circular cross section. It is obvious that any other cross section could also be selected, for example, a square cross section, the corners of which are rounded.

The spacing between the adjacent walls 25 and 26 of the grooves in the sleeve 9 and the bush 10 plays a very important part. It must be sufficiently large to ensure adequate fluid tightness between the parts and to reduce constraining forces set up during the initial clamping of the bush 10 onto the sleeve 9, but, on the other hand, it must be small as possible so that variations in the viscosity of the fluid, which variations are inherent with variations of temperature, do not excessively alter the characteristics of the buffer.

I claim:

1. A hydraulic buffer for a vehicle including a chassis, a housing mounted on said chassis, a cylinder mounted in said housing said cylinder forming part of a piston and cylinder arrangement a buffer plate mounted on said cylinder, the longitudinal axis of said cylinder extending substantially parallel to the longitudinal axis of said vehicle, said cylinder and said piston together defining a chamber for hydraulic fluid whereby forces tending to compress said buffer pressurize said hydraulic fluid, a reservoir in said housing for storing said hydraulic fluid, conduit means connecting said chamber to said reservoir for said fluid, valve means capable of permitting the outflow of said hydraulic fluid from said chamber into said reservoir and being in communication with said conduit means, non-return valve means capable of permitting the inflow of said hydraulic fluid into said chamber from said reservoir also being in communication with said conduit means, spring biassing means located within said cylinder acting to return said piston and cylinder arrangement of said buffer to their rest position and wherein the said valve means comprises at least one perforated resilient sleeve, the interior of said sleeve communicating with the interior of said chamber, and at least one resilient bush mounted on the periphery of said sleeve, an increase in pressure of said hydraulic fluid in said chamber acting to increase the diameter of said bush and to reduce the diameter of said sleeve thereby causing elastic deformation between said bush and said sleeve, the play between the bush and the sleeve constituting the opening of said valve means.

2. A buffer as recited in claim 1 wherein said sleeve has at least one annular groove formed on its surface forming the interface between said bush and said sleeve.

3. A buffer as recited in claim 1, wherein said bush has at least one annular groove formed on its surface forming the the interface between said bush and said sleeve.

4. A buffer as recited in claim 1 wherein said bush and said sleeve are both substantially cylindrical, said bush having an internal diameter less than the external diameter of said sleeve, said bush being a press-fit on said sleeve such that said bush and said sleeve remaining in sealing contact with one another until the pressure of said hydraulic fluid in said chamber exceeds a predetermined value.

5. A buffer as recited in claim 1 wherein said cylinder additionally includes an exhaust port formed in a wall of said cylinder, conduit means of narrow cross-section extending between said port and said piston, said conduit starting from a point disposed towards the upper generatrix of the chamber, by-passing said valve means and permitting, during a compression movement of said buffer, the exhausting of any air present in said chamber through said exhaust port into said housing.

6. A buffer as recited in claim 5, wherein said exhaust port is closed by displacement of said piston by the continued application of compressive forces to the buffer.

7. A buffer as recited in claim 1 wherein said reservoir is disposed below said piston and cylinder arrangement, said non-return valve being carried by said piston and being immersed in said hydraulic fluid in said reservoir.

8. A buffer as recited in claim 1 including auxiliary spring-biassing means of reduced movement, said auxiliary spring-biassing means being located within said housing and being compressible by forces tending to compress said buffer, thereby increasing its elasticity.

9. A hydraulic buffer for a vehicle including a chassis, said buffer including a buffer plate, a housing mounted on said chassis, a cylinder mounted in said housing, said buffer plate being mounted on said cylinder, said cylinder forming part of a piston and cylinder arrangement the longitudinal axis of said cylinder extending substantially parallel to the longitudinal axis of said vehicle, said cylinder and said piston together defining a chamber for hydraulic fluid, wherey forces tending to compress said bubber pressurize said hydraulic fluid, a reservoir for said hydraulic fluid, conduit means connecting said chamber to said reservoir for said fluid, valve means capable of permitting the outflow of said hydraulic fluid from said chamber into said reservoir being in communication with said conduit means, non-return valve means capable of permitting the inflow of said hydraulic fluid into said chamber from said reservoir also being provided in said conduit means and spring biassing means located within said cylinder acting to return said piston and cylinder arrangement of said buffer to their rest position and wherein said valve means comprises at least one perforated resilient sleeve, the interior of said sleeve communicating with the interior of said chamber, and at least one resilient bush mounted on the periphery of said sleeve, an increase in pressure of said hydraulic fluid in said chamber acting to increase the diameter of said bush and to reduce the diameter of said sleeve thereby causing elastic deformation between said bush and said sleeve, the play between the bush and the sleeve constituting the opening of said valve means.

10. A buffer as recited in claim 10 wherein said sleeve has at least one annular groove formed on its surface forming the interface between said bush and said sleeve.

11. A buffer as recited in claim 9 wherein said bush has at least one annular groove formed on its surface forming the interface between said bush and said sleeve.

12. A buffer as recited in claim 9 wherein said bush and said sleeve are both substantially cylindrical, said bush having an internal diameter less than the external diameter of said sleeve, said bush being a press-fit on said sleeve such that said bush and said sleeve remain in sealing contact with one another until the pressure of said hydraulic fluid in said chamber exceeds a predetermined value.

13. A buffer as recited in claim 9 wherein said cylinder additionally includes an exhaust port formed in a wall of said cylinder, conduit means of narrow cross-section extending between said port and said piston, said conduit starting from a point disposed towards the upper generatrix of the chamber, by-passing valve means and permitting, during a compression movement of said buffer, the exhausting of any air present in said chamber through said exhaust port into said housing.

14. A buffer as recited in claim 13 wherein said exhaust port is closed by displacement of said piston by the continued application of compressive forces to the buffer.

15. A buffer as recited in claim 9 wherein said reservoir is disposed below said piston and cylinder arrangement, said non-return valve being carried by said piston and being immersed in said hydraulic fluid in said reservoir.

16. A buffer as recited in claim 9 including auxiliary spring-biasing means of reduced movement, said auxiliary spring-biassing means being located within said housing, and being compressible by forces tending to compress said buffer, thereby increasing its elasticity.

* * * * *